United States Patent [19]

Kesselring

[11] Patent Number: 4,626,235

[45] Date of Patent: Dec. 2, 1986

[54] APPARATUS FOR ASSEMBLING EXPANDABLE PRODUCT BAGS WITHIN ENERGY SLEEVES

[75] Inventor: Wolfgang Kesselring, Goshen, Conn.

[73] Assignee: Jamieson Manufacturing Company, Torrington, Conn.

[21] Appl. No.: 708,745

[22] Filed: Mar. 6, 1985

[51] Int. Cl.[4] ..... B31B 1/60

[52] U.S. Cl. ..... 493/210; 53/470; 53/556; 53/585; 264/294; 493/297; 493/379

[58] Field of Search ..... 493/84, 93, 210, 217, 493/223, 273, 294, 297, 311, 312, 343, 379, 386, 388, 390, 255, 256; 53/556, 585, 470; 264/294

[56] References Cited

U.S. PATENT DOCUMENTS

| | | | |
|---|---|---|---|
| 3,803,991 | 4/1974 | Leader | 493/217 |
| 4,144,631 | 3/1979 | Fujio | 53/556 |
| 4,188,249 | 2/1980 | Fujio | 53/585 |
| 4,514,966 | 5/1985 | Konstantin | 53/557 |

*Primary Examiner*—Francis S. Husar
*Assistant Examiner*—Robert Showalter
*Attorney, Agent, or Firm*—McCormick, Paulding & Huber

[57] ABSTRACT

Apparatus for assembling axially elongated, diametrically expandable and contractible product bags axially within energy sleeves of elastomeric material which are at least partially diametrically expanded at assembly. The apparatus comprises three, (3) energy sleeve expansion stations where at the elastomeric sleeve is sequentially expanded by the insertion of expansion rods and/or tubes therewithin. From the third station the energy sleeves proceed to an assembly station with an expansion tube therewithin. At the assembly station a product bag is inserted axially within the expansion tube in the energy sleeve with an end portion protruding from the tube. A first mechanism moves the energy sleeve axially relative to the tube so that an end portion surrounds and frictionally grips a part of the protruding product bag. A second assembly mechanism grips the protruding end portion of the bag and withdraws the bag from within the expansion tube with the energy sleeve following and sliding axially from its position about the expansion tube.

10 Claims, 16 Drawing Figures

APPARATUS FOR ASSEMBLING EXPANDABLE PRODUCT BAGS WITHIN ENERGY SLEEVES

BACKGROUND OF THE INVENTION

Apparatus is available for expanding and thereafter assembling tubular or sleeve-like members on and about bottles and other rigid containers. Such apparatus, however, is unsatisfactory in the expansion and subsequent assembly of an energy sleeve of elastomeric material on and about an axially elongated, diametrically expandable and contractible product bag. Such an assembly is useful in dispensing a multitude of product types from such a bag which may thereafter be further expanded with the product therewithin and the sleeve thereabout and which will of course be provided with a manually operable dispensing valve.

It is the general object of the present invention to provide apparatus for assembling an axially elongated, diametrically expandable and contractible product bag axially within an energy sleeve of elastomeric material and which is at least partially diametrically expanded at assembly.

SUMMARY OF THE INVENTION

In accordance with the present invention and in fulfillment of the aforementioned general object, expansion and assembly apparatus is provided and has at least one energy sleeve expansion station and at least one energy sleeve and product bag assembly station. A support means is provided at the sleeve expansion station for holding an energy sleeve at the station with at least one open end portion exposed axially. A hollow tubular expansion means at the station is axially insertable into the sleeve at its said exposed open end portion whereby to progressively expand the sleeve substantially throughout its length. With the sleeve expanded on and about the expansion means, the assembled elements are transported in unison to the assembly station. A product bag is also transported to the assembly station and the bag and the assembled sleeve and expansion means are arranged in a position of axial alignment. Means for effecting relative axial movement between the assembled sleeve and expansion means and the product bag are provided whereby to insert the bag within the hollow expansion means in the sleeve with one end portion of the bag protruding from the expansion means and the sleeve. A means for effecting relative axial movement between the sleeve and the assembled expansion means and product bag positions the sleeve with one end portion extending beyond the expansion means and surrounding the bag along at least a part of its said protruding end portion. The sleeve thus frictionally grips the bag at the protruding end portion of the latter due to the contractive tendency of the sleeve in its expanded condition. Finally, a means for engaging the protruding end portion of the product bag is provided and engages said end portion at a remaining part thereof and simultaneously withdraws the bag from within the expansion means and withdraws the sleeve from its position about the expansion means.

Preferably three expansion stations are provided for the energy sleeves and each of said stations includes an expansion means axially insertable within an energy sleeve. An expansion means at a first station is axially insertable within an expansion means at a second station whereby to transfer an energy sleeve to and about the expansion means at the second station. In turn, an expansion means at the second station is axially insertable within an expansion means at the third station to transfer the energy sleeve to and about the expansion means at said third station. Transfer means are provided between said expansion stations and include indexable tables for transporting said expansion means with energy sleeves thereon. Said tables serve to axially align successive expansion means and sleeves for the axial transfer of the sleeves from one expansion means to the next. It is also the presently preferred practice to include air jet means for assistance in initiating the necessary expansion and axial transfer movement of the energy sleeves from one expansion means to another.

In one embodiment of the invention a continuous supply of elastomeric energy sleeve material is provided and lengths of such material are intermittently severed as required to form individual energy sleeves. A transfer means is provided for introducing the energy sleeves in succession to the aforementioned first expansion station.

In a further embodiment of the invention, pre-cut energy sleeves are provided and stored and a feed means is provided for intermittently introducing the sleeves in succession to the first expansion station.

Finally, a preferred form of the invention includes a discharge means which is provided for engaging and laterally moving assembled energy sleeves and product bags after removal of the same from the final expansion means.

DESCRIPTION OF PREFERRED EMBODIMENTS

Figure 1:
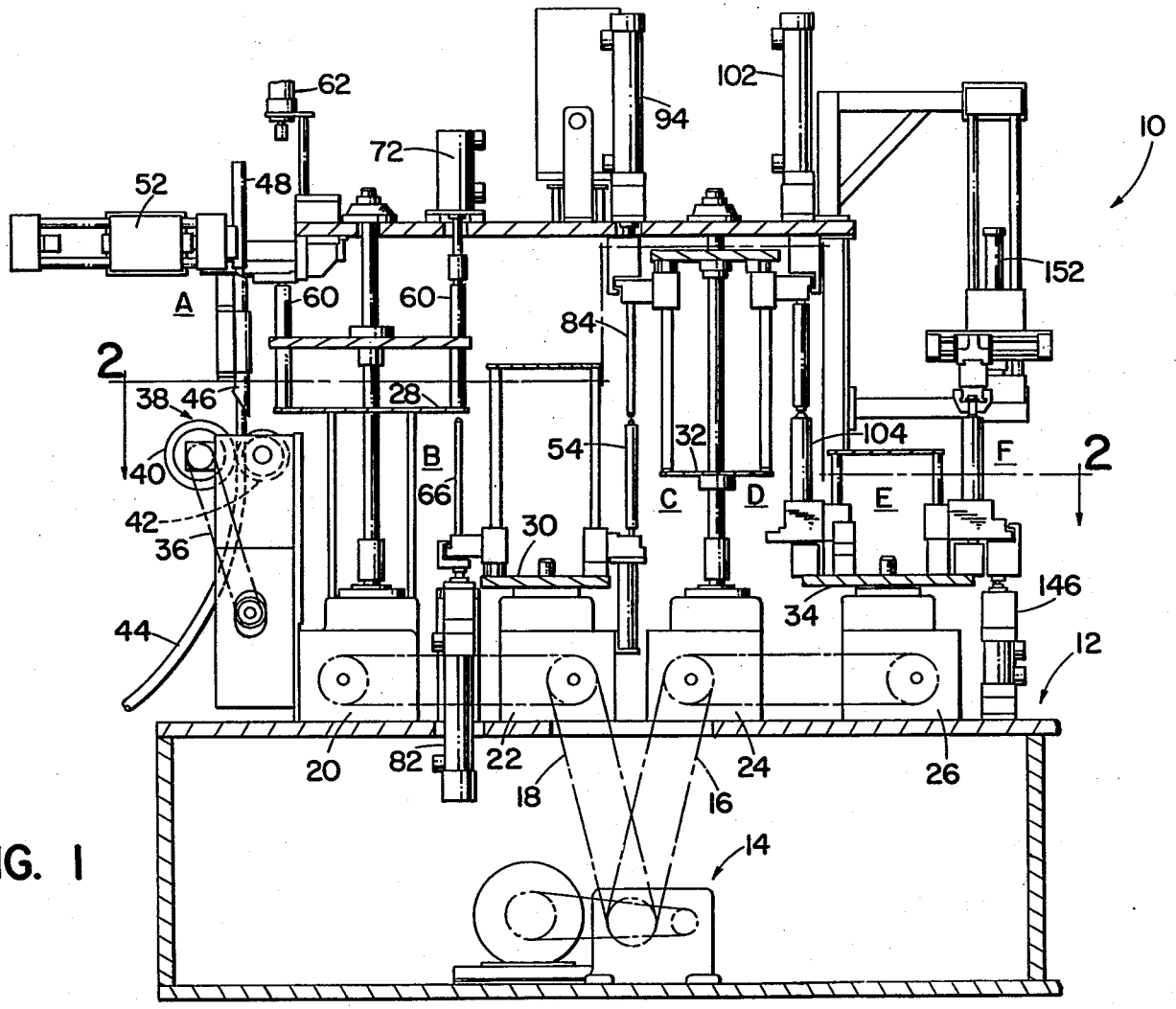
FIG. 1 of the drawings is a schematic side view of the energy sleeve and product bag assembly apparatus of the present invention.
Figure 2:
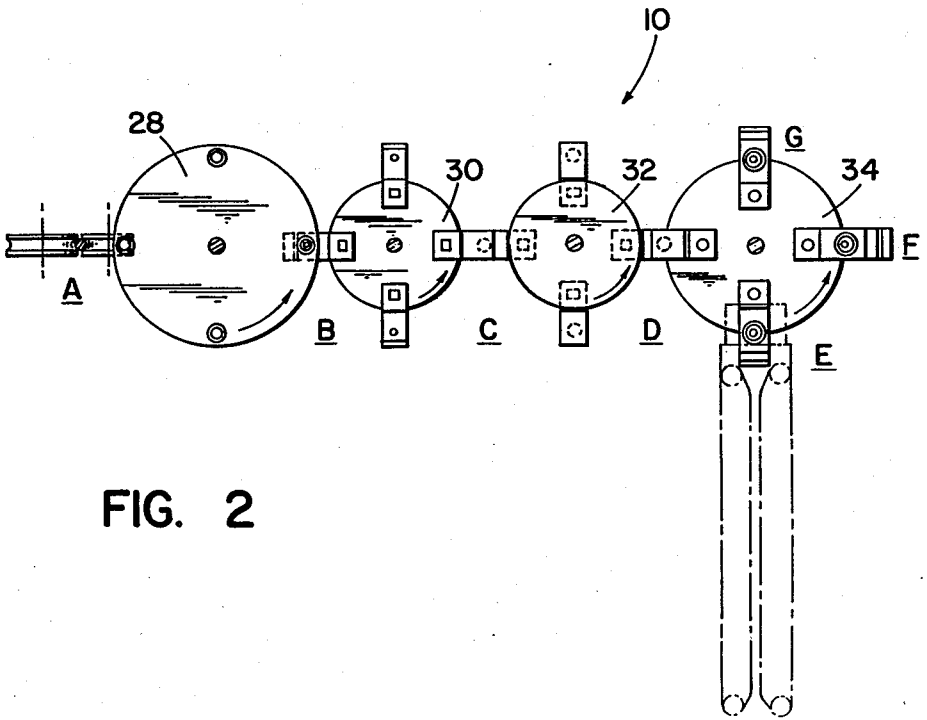
FIG. 2 is a schematic horizontal section taken generally as indicated at 2, 2 in FIG. 1 and showing a series of indexing tables and transfer means forming a part of the apparatus.
Figure 11:
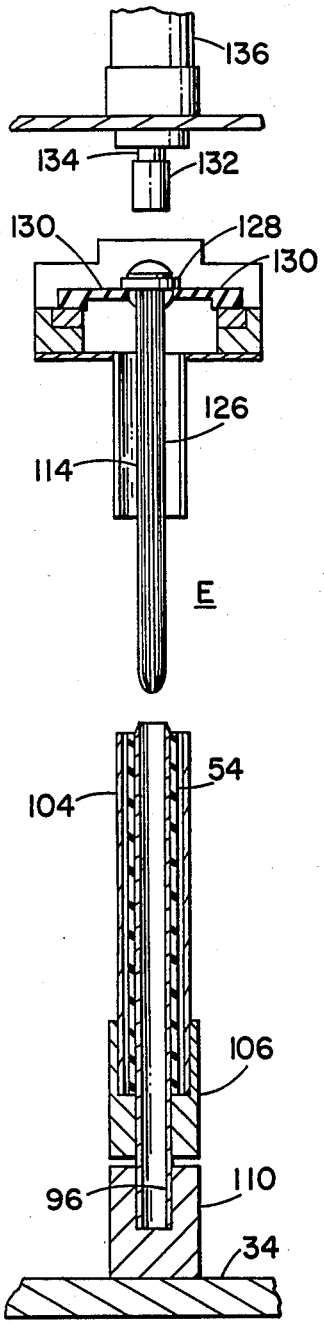
FIG. 11 is an enlarged fragmentary vertical section in schematic form of an assembly station showing the third expansion means within the energy sleeve and the second transfer tube and a product bag in axial alignment therewith prior to insertion of the bag within the expansion means.

Referring particularly to FIGS. 1 and 2, an apparatus indicated generally at 10 is adapted for the assembly of axially elongated, diametrically expandable and contractible product bags axially within energy sleeves of elastomeric material and which are at least partially diametrically expanded at assembly. The machine includes a frame indicated generally at 12 which supports the various operating elements and, in FIG. 1, a sleeve severing station is provided at A, a first sleeve expansion station at B, a second sleeve expansion station at C and a third sleeve expansion station at D. An energy sleeve and product bag assembly station is omitted at E in FIG. 1 for clarity of illustration but is clearly illustrated in FIGS. 11 and 12. At F, a sleeve and bag withdrawal station is illustrated in both FIG. 1 and in FIGS. 14 and 15, and station G indicated in FIG. 2 may be employed as a discharge station for the assembled energy sleeves and product bags.

The various operating mechanisms of the apparatus at the stations A–G may be driven from a power supply means 14 in the form of an electric motor, speed reducer, etc., and belts 16, 18 extending to gear boxes 20, 22, 24 and 26. Four (4) indexing tables 28, 30, 32 and 34, FIG. 2, are respectively driven by the gear boxes 20, 22, 24 and 26 through suitable drive shafts. The indexing tables 28–34 may be rotated in a counterclockwise direction as indicated in FIG. 2 in 90° increments of rotation by means of suitable control means for the motor, gear boxes, etc., which may vary widely in form and which do not constitute a part of the present invention. The various operations occurring at the stations A–G are largely powered by fluid cylinders, more specifically pneumatic cylinders, as will be described hereinbelow and the operation of such cylinders may of course also be regulated by control means in suitable timed relationship with the indexing operation of the tables 28–34. A drive belt 36 for an energy sleeve feed means 38 may be independently operated or may be driven from the main power source 14.

Figure 3:
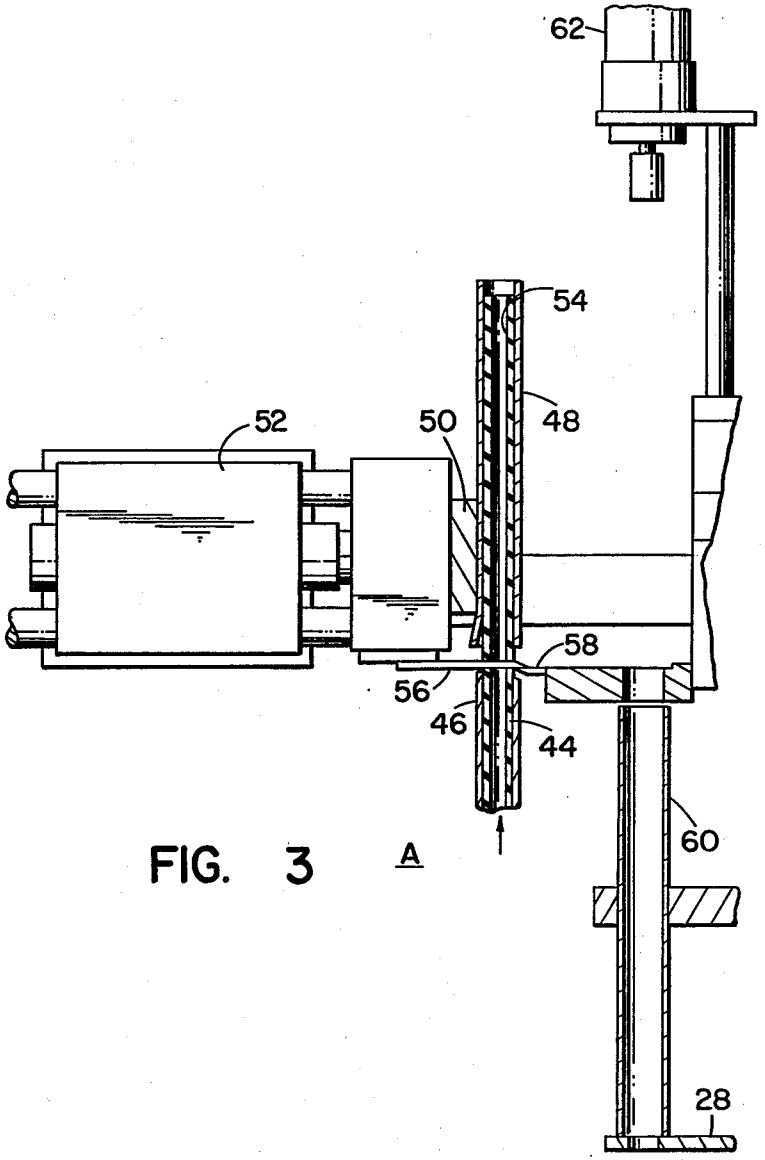
FIG. 3 is an enlarged fragmentary vertical section in schematic form showing a means for severing individual energy sleeves and for transfering the same to a vertical transfer tube mounted on a first indexable table.

The sleeve feed means 38 comprises feed rolls 40, 42 in FIG. 1 which intermittently draw continuous energy sleeve material 44 from a supply roll or the like, not shown. The feed rolls 40, 42 urge the energy sleeve material upwardly into a guide 46 and thence to a transfer tube 48 which is open at the bottom to receive the leading end portion of the energy sleeve material. The transfer tube 48 is mounted on a support member 50 which is in turn operated by a fluid cylinder 52 for left and right hand movement in FIGS. 1, 3 and 4. As illustrated in FIG. 3, the tube 48 is maintained at a left hand position for receiving a leading end portion of the sleeve material 44 and is thereafter moved rightwardly to the FIG. 4 position subsequent to severing of the leading end portion of the material to form an individual energy sleeve 54 as in FIG. 3. A movable knife 56 cooperates with a fixed knife 58 in the severing operation and the knife 56 may be operated by a separate fluid cylinder, not shown, independently of the aforementioned cylinder 52. Thus, the individual energy sleeve 54 is first severed by rightward movement of the knife 56 into engagement with the knife element 58 whereupon an individual elastomeric energy sleeve 54 is provided in the tube 48. The cylinder 52 is then operated to position the transfer tube 48 rightwardly as shown in FIG. 4.

Figure 4:
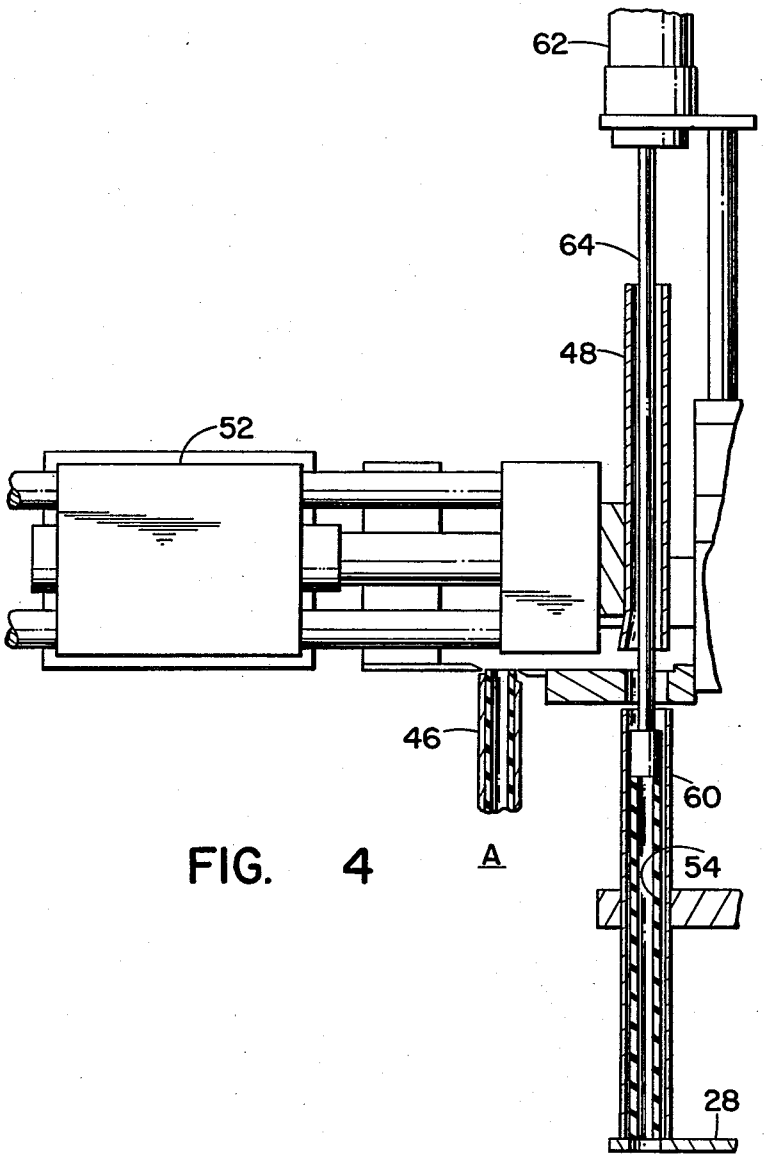
FIG. 4 is a view similar to FIG. 3 but showing a severed individual energy sleeve inserted into the transfer tube.

A transfer tube 60 is disposed beneath and in axial alignment with the transfer tube 48 at the FIG. 4 position of the tube 48. Thus, a fluid cylinder 62 disposed above the transfer tube 48 may operate to extend its piston rod 64 downwardly as shown and to urge the energy sleeve 54 downwardly from the transfer tube 48 into the tube 60 as illustrated. The transfer tube 60 is mounted on the aforementioned indexable or indexing table 28 and in FIG. 2 the transfer tube 60 is at the 9 o'clock position for loading.

Figure 5:
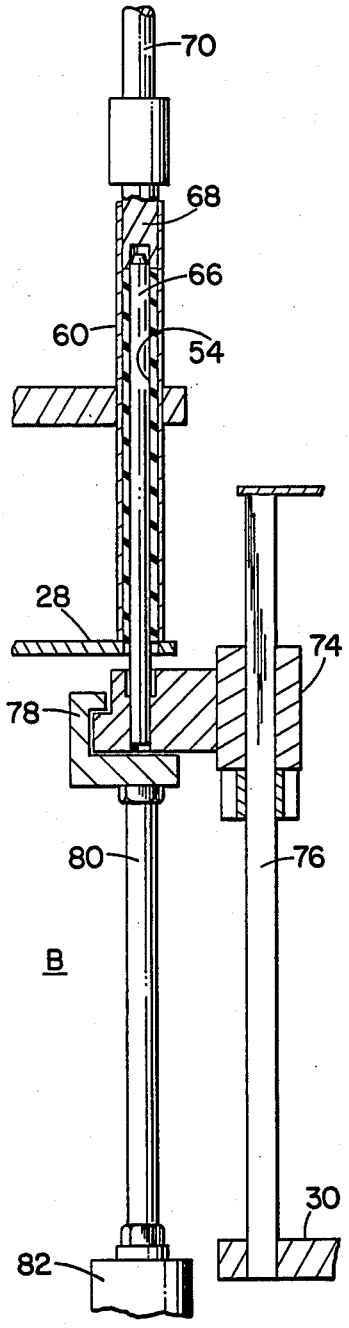
FIG. 5 is an enlarged fragmentary vertical section in schematic form showing a first expansion station wherein an expansion means is illustrated in position within the energy sleeve of FIGS. 3 and 4 and within the transfer tube.

In FIG. 5, the transfer tube 60 is shown indexed by the table 28 through 180° to the 3 o'clock position in FIG. 2 and to the first expansion station B in FIGS. 1 and 2. Thus, a first expansion means 66 is illustrated in FIG. 5 inserted axially within the energy sleeve 54 so as to expand the sleeve within tube 60, the tube 60 having a loose fit about the sleeve to accommodate such expansion. A small plunger 68 is shown disposed within the upper end portion of the tube 60 at the FIG. 5 position and is moved upwardly and downwardly as required on a piston rod or plunger 70 operated by a small fluid cylinder 72 in FIG. 1. Thus, the member 68 serves as a stop securing the sleeve 54 against upward movement in the tube 60 during the axial upward entry of the expansion means or rod 66 within the sleeve. The expansion rod 66 is carried by a slide member 74 which moves upwardly and downwardly on a vertical guide rod 76 and which is operated by a latching member 78 and a rod 80 of a fluid cylinder 82 disposed therebeneath. The latching member 78 may be disposed at the 3 o'clock position relative to the table 28 and the 9 o'clock position relative to the indexing table 30 so as to engage the slide 74 as the latter is rotated to the 9 o'clock position by the table 30. As will be apparent in FIG. 1, the table 30 carries the rod 76 and rotates the same whereby to rotate the slide 74 and the expansion means or rod 66 therewith.

Figure 6:
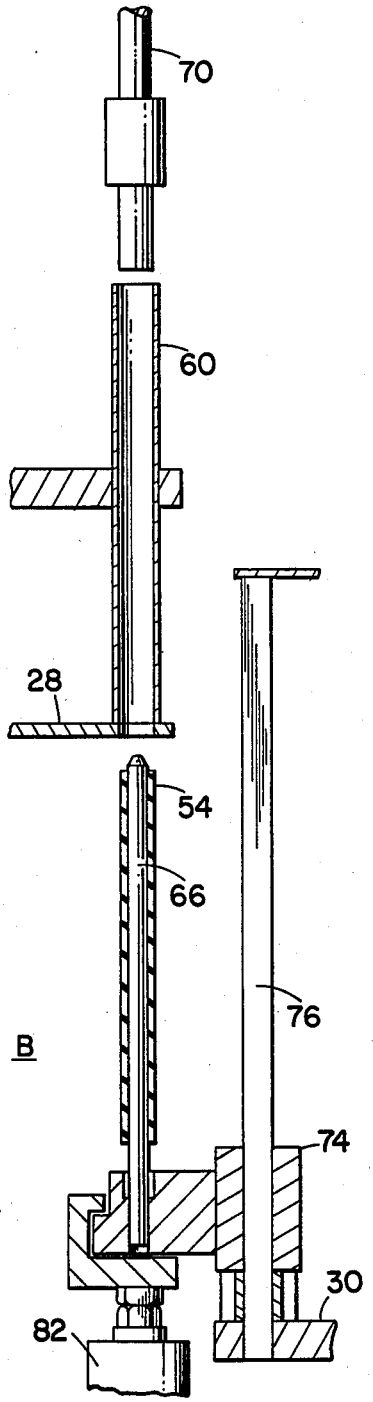
FIG. 6 is a view similar to FIG. 5 but shows the first expansion means withdrawn from the transfer tube with the energy sleeve disposed thereabout.

In FIG. 6, the table 30 remains in the FIG. 5 position but the slide 74 has now been withdrawn downwardly by the piston 82 whereby to withdraw the expanded energy sleeve 54 from the transfer tube 60. The expansion rod 66 and the sleeve 54 are now in condition for indexing movement of the table 30 to bring the rod 76, slide 74, rod 66 and the sleeve 54 to the second expansion station C in FIGS. 1 and 2.

Figure 7:
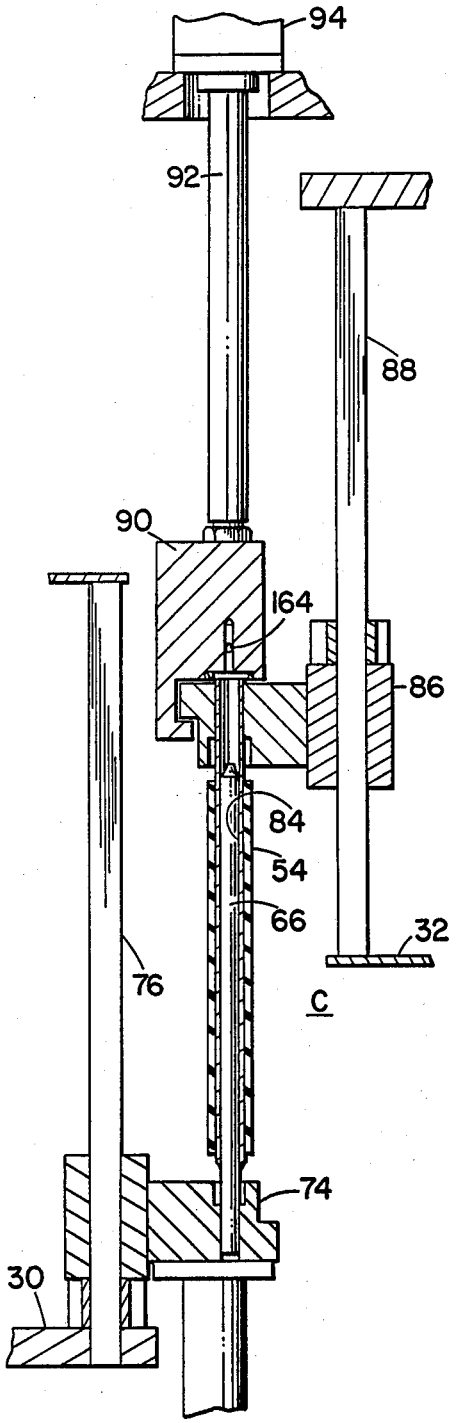
FIG. 7 is an enlarged fragmentary vertical section in schematic form showing a second expansion station wherein a second expansion means is shown in position on and about the first expansion means and within the energy sleeve.
Figure 8:
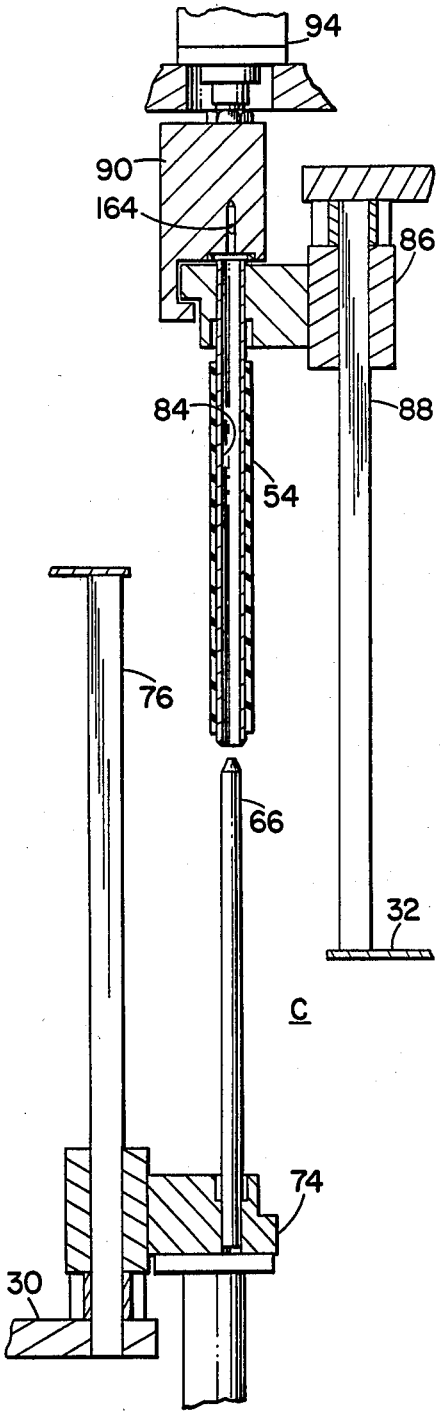
FIG. 8 is a view similar to FIG. 7 but shows the second expansion means withdrawn from its position about the first expansion means with the energy sleeve mounted thereon.

The second expansion station C is illustrated in FIGS. 7 and 8 and corresponds to the 3 o'clock position of the table 30 and the 9 o'clock positon of the table 32. In FIG. 7, a second expansion means 84 is shown entered axially within the sleeve 54 and about the first expansion means or rod 66. The expansion means 84 comprises a thin walled tube which is moved axially downwardly by means of a slide 86 guided on a vertical rod 88 and a latching member 90 which is operated by a piston rod 92 associated with a fluid cylinder 94. The slide and latching member 86 and 90 are engaged at the station C by rotation of the indexing table 32 whereupon the fluid cylinder 94 may be operated to urge the tube 84 downwardly to the position shown in FIG. 7 for insertion within the energy sleeve 54 and for the second stage expansion of the tube 54.

In FIG. 8, the fluid cylinder 94 has been operated to withdraw the latching member 90 upwardly whereby to withdraw the sleeve 86 upwardly along its guide rod 88 and to withdraw the expansion tube 84 from the expansion rod 66, the energy sleeve 54 now being disposed on and about the tube 84. A latching means not shown operates to retain the slide 74 which carries the rod 66 against upward movement along its guide rod 76 at the station C.

Figure 9:
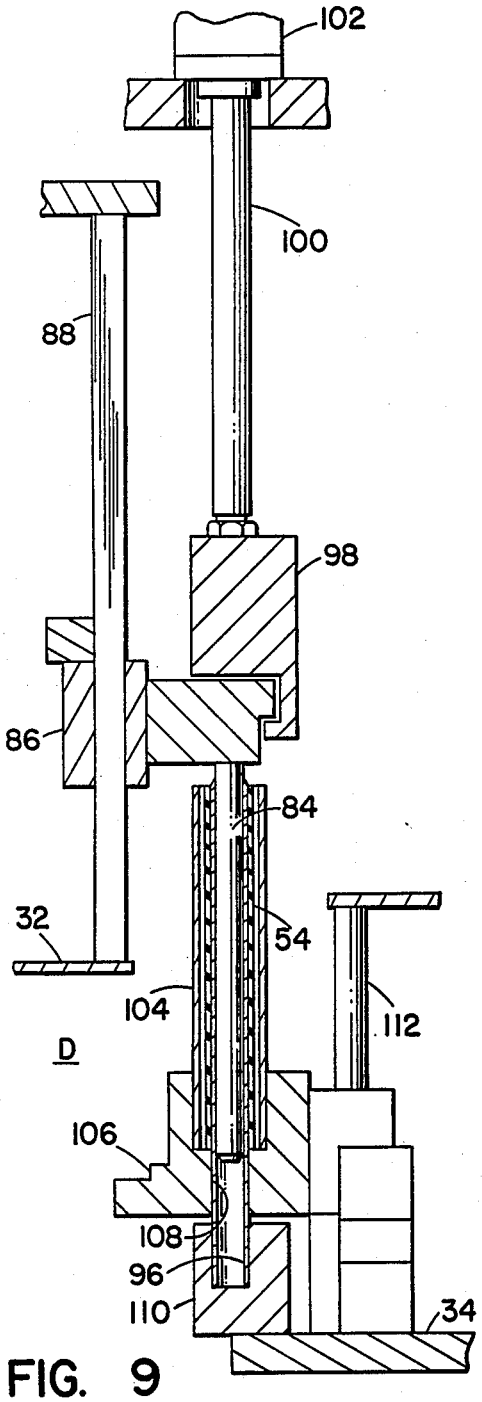
FIG. 9 is an enlarged fragmentary vertical section in schematic form showing a third expansion station with a third expansion means disposed about the second expansion means and within the energy sleeve and within a second transfer tube.
Figure 10:
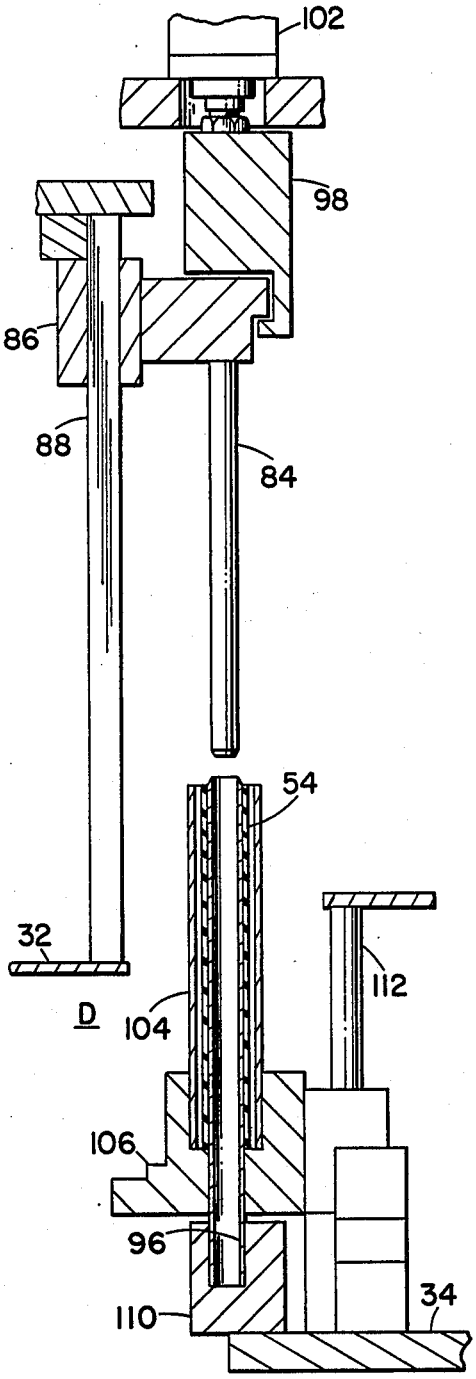
FIG. 10 is a view similar to FIG. 9 but shows the second transfer means withdrawn from its position within the third transfer means.

At the third expansion station D illustrated in FIGS. 9 and 10, the indexing table 32 rotates the rod while the indexing table 34 rotates the third expansion means 96 and its associated elements to the 9 o'clock position. The third expansion means 96 comprises a thin walled tube which is open at its ends and which receives the second expansion means or tube 84 in downward axial movement of the tube 84 at the urging of its supporting slide 88 and a latching member 98, a piston rod or plunger 100, and a fluid cylinder 102 associated with a rod 100. That is, at the station D with the table 32 in the 3 o'clock position, the latching member 98 engages the slide 88 and on actuation of the cylinder 102 and downward movement of its piston rod 100, the expansion tube 84 is moved downwardly within the expansion tube 96 whereupon the energy sleeve 54 is expanded for a third time as it is progressively stripped from the tube 84 and disposed on and about the third expansion tube 96. The energy sleeve 54 is also disposed within an associated shield tube 104 which is in coaxial relationship with the tube 96 and the sleeve and is secured in a slide 106 in common with the tube 96. That is, the lower end portion of the tube 104 is fixedly mounted in the slide 106. The tube 96 is mounted in an opening 108 in the slide 106 but is slideable relative thereto and projects downwardly therefrom to a lower position where it is fixedly mounted in a mounting block 110 secured to the table 34. The slide 106 has an associated vertical guide rod 112 also mounted on the table 34.

In the FIG. 10 illustration of the third expansion station D, the second expansion tube 84 is shown withdrawn upwardly from within the third expansion tube 96 by upward movement of its supporting slide 88, latching member 98 and operation of the fluid cylinder 102. In this view, the energy sleeve 54 and third expansion means or tube 96 are in a condition of readiness for assembly of the sleeve and tube with a product bag at the assembly station E, best illustrated in FIG. 2, 11 and 12.

Figure 13:
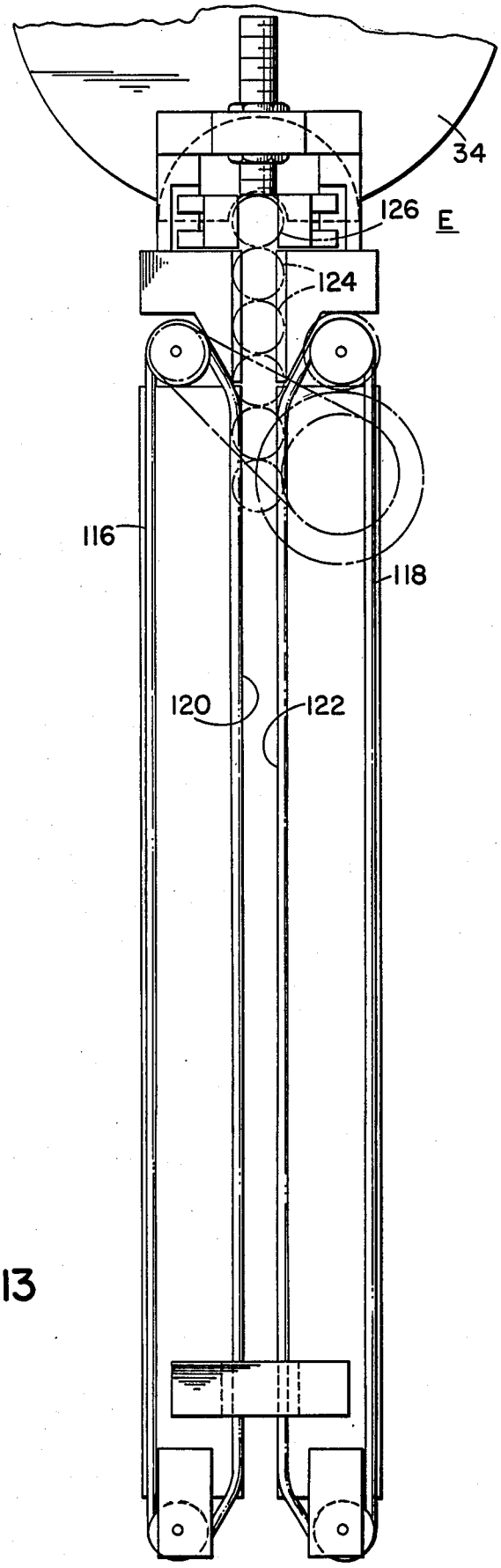
FIG. 13 is an enlarged fragmentary horizontal sectional view in schematic form showing a conveyor means for delivering product bags to the assembly station of FIGS. 11 and 12.

The product bags under consideration are axially elongated, diametrically expandable and provided with longitudinal or axial folds or pleats 114. The diameter of the bags in their contracted or relaxed condition is such as to permit the bag to freely enter the third expansion tube 96 at the assembly station E. As best illustrated in FIG. 13, a delivery means for the product bags is preferably provided and may comprise a pair of parallel conveyor belts 116, 118 having parallel inner runs 120, 122 which are moved in the same direction and in unison so as to transport a series of product bags 124 to a position of a bag 126 above and in axial alignment with the expansion tube 96 at the assembly station E. Thus, the bag 126 in FIG. 11 may be provided with a closure means or cap 128 which is supported by a pair of flexible fingers 130, 130 so as to be urged downwardly by means of a plunger 132 on a piston rod 134 operated by fluid cylinder 136.

Figure 12:
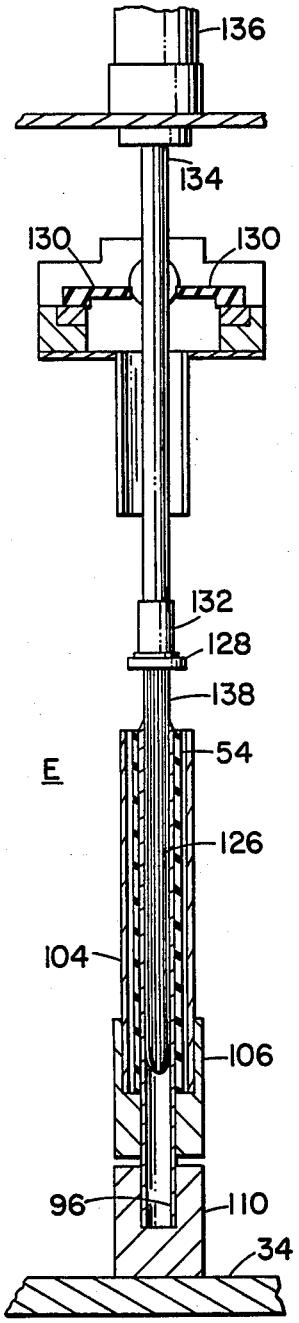
FIG. 12 is a view similar to FIG. 11 but shows the product bag inserted within the hollow expansion means with an upper portion of the bag protruding from the expansion means and the sleeve.

As best illustrated in FIG. 12, the closure means for cap 128 is slightly enlarged diametrically and is engaged and urged downwardly from between the fingers 130, 130 for axial entry into the tube 96, but the bag 126 is stopped in its downward axial movement by operation of the cylinder 136 so as to have an upper portion thereof at 138 protrude from the tube 96 and the energy sleeve 54.

Figure 14:
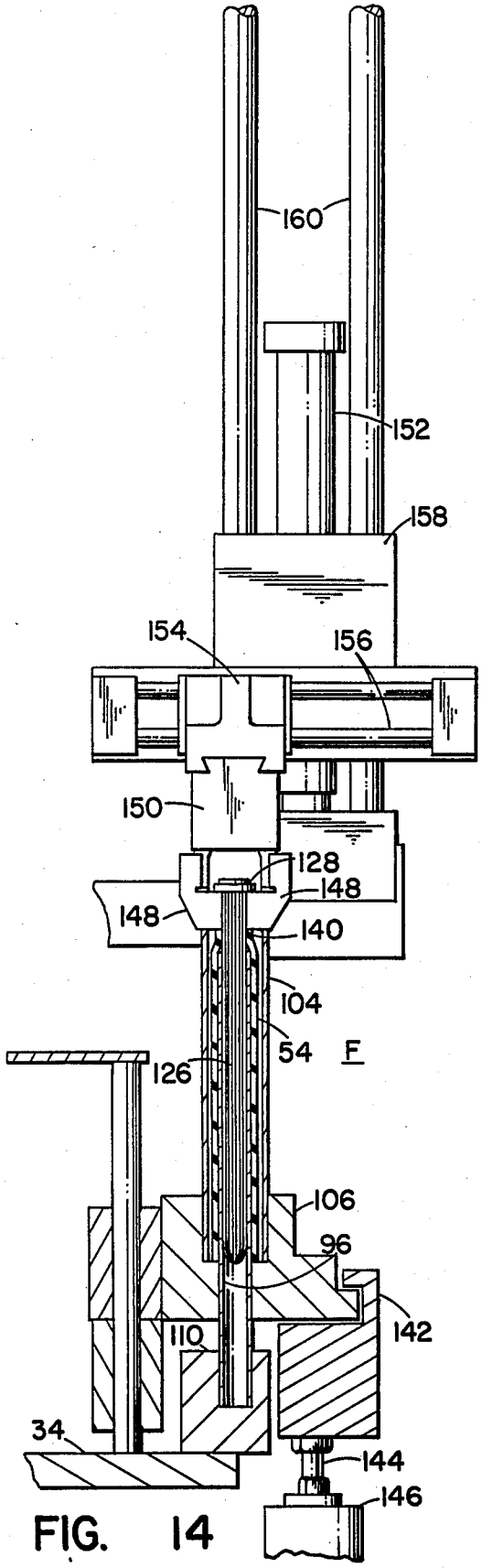
FIG. 14 is an enlarged fragmentary vertical, sectional view in schematic form showing the product bag, expansion means, energy sleeve, and transfer tube at a sleeve and bag withdrawal station wherein a first means has moved the energy sleeve relative to the expansion means and a further bag and sleeve withdrawal device has engaged the upper portion of the bag.

At the energy sleeve and product bag withdrawal station F, a first movable means urges the energy sleeve 54 upwardly as illustrated in FIG. 14 over a limited axial distance so that an upper portion thereof at 140 is moved beyond the upper end portion of the expansion tube 96 and is disposed about and in frictional engagement with a part of the protruding portion 138 of the product bag. Thus, a latching member 142 is associated with a piston rod 144 and a fluid cylinder 146 and engages the aforementioned slide 106 at the withdrawal station F with the table 34 indexed to rotate the aforesaid elements to the 3 o'clock position. On limited upward vertical movement of the latching member 142 and the slide 106, the tube 96 is retained in its vertical position by the fixed mounting thereof within the block 110 and the energy sleeve thus slides upwardly thereabout. The shield 104 moves upwardly with the slide 106 with the energy sleeve and, at an upper end portion, the sleeve and the tube engage a pair of swingable fingers 148, 148. The fingers 148, 148 engage an upper part of the protruding portion 138 of the bag 126 and upward movement from the FIG. 14 to the FIG. 15 position of the fingers withdraws the product bag 126 axially from within the expansion tube 96. Due to the frictional gripping action of the energy sleeve at 140 in the short axial space between the upper end of the tube 96 and the fingers 148, 148 such withdrawal of the bag 126 also results in withdrawal of the energy sleeve 54 from its position about the tube 96. The withdrawal fingers 148, 148 are shown in engagement with the closure means or cap 128 and have an associated mounted block 150 which is moved upwardly and downwardly by means of a fluid cylinder 152. The block 150 is carried by a horizontal slide 154 mounted on guide rods 156, 156 in turn mounted on a vertical slide 158 on guide rods 160, 160.

Figure 15:
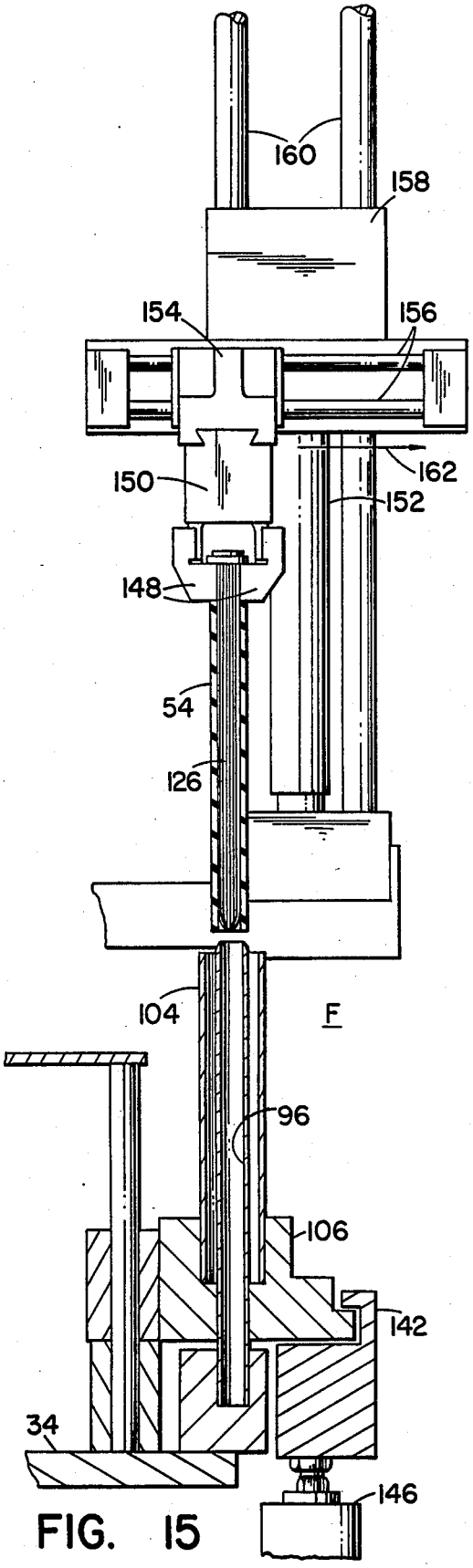
FIG. 15 is a view similar to FIG. 14 but shows the product bag and energy sleeve fully withdrawn from the expansion means and transfer tube and in assembled condition.

As will be apparent, the slide 154 may be moved in the direction of the arrow 162 from the position shown in FIG. 15 by a fluid cylinder of the like, not shown, and the product bag 126 and energy sleeve 54 supported by the associated fingers 148, 148 will be thus moved to an outboard positon relative to the table 34 at a discharge station G. From this position, the fingers 148, 148 may be operated so as to swing to an open position allowing the bag and sleeve to be discharged as desired.

As an aid in the initial enlargement of the leading edge portion of an energy sleeve during transfer from one expansion means to the next it is the presently preferred practice to provide a small air jet as illustrated, for example, in FIGS. 7 and 8 at 164. Air under pressure emitted from the jet 164 and confined within the expansion tube 84 serves as the lower edge portion of the tube initially engages the sleeve 54 in the downward movement of the tube to "lubricate" or to aid in the initial enlargement of the tube 54 and in the entry of the lower end portion of the tube 84 between the sleeve 54 and the first enlarging means 66. Such air jet means may of course be employed at any of the several expansion stations in the apparatus.

Figure 16:
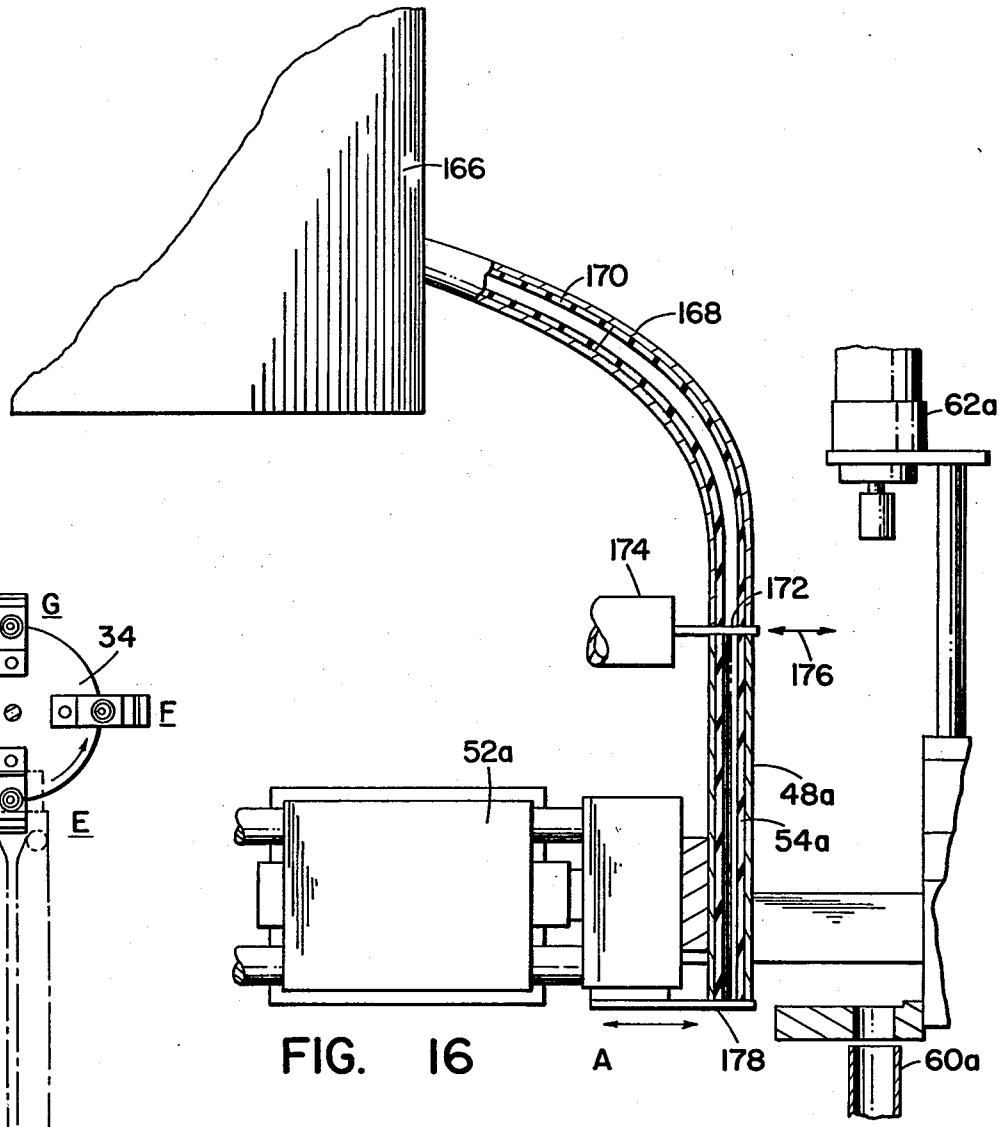
FIG. 16 is an enlarged fragmentary vertical section in somewhat schematic form showing a second embodiment of the apparatus wherein energy sleeves are provided in pre-cut individual form and are fed individually to a transfer means for delivery to the first transfer tube.

FIG. 16 illustrates a second embodiment of the delivery means for the energy sleeves. A storage means 166 has an associated discharge tube 168 for the delivery of individual energy sleeves 170 in succession to a stop member 172 at a lower end portion of the tube. The stop member 172 may be moved by a small fluid cylinder, solenoid or the like at 174 in the direction of the arrows 176 whereby to move into a space between a lower end portion of the tube 168 and an upper end portion of transfer tube 48*a* and to prevent an energy sleeve 170 from falling at the urging of gravity to the position shown within the transfer tube 48*a*. As will be apparent, energy sleeves such as the sleeve 54*a* in the transfer tube 48*a* will thus be permitted to enter the tube 48*a* in succession and in timed relationship with the operation of the remaining operating elements in the apparatus. A fluid cylinder 52*a* operates an arresting means or gate 178 which holds the energy sleeves 54*a* in the transfer tube 48*a* and moves the transfer tube to the right hand position above a transfer tube 60*a*, as in the FIG. 3 and FIG. 4 apparatus. When the gate 178 is withdrawn leftwardly with the transfer tube 48*a* disposed above and in axial alignment with the transfer 60*a* a small plunger 64*a* is moved downwardly at the urging of a fluid cylinder 62*a* whereby to urge the energy sleeve 54*a* downwardly and to discharge the same from the transfer tube 48*a* into the transfer tube 60*a* as in the aforementioned operation of the FIG. 3 and FIG. 4 apparatus.

As will be apparent from the foregoing, the apparatus of the present invention is adapted to efficiently expand energy sleeves as required for the axial introduction of product bags to a position therewithin in an assembly operation. Thereafter, the bags, with a portion thereof protruding, are engaged by a limited axial portion of the energy sleeve to create a frictional tie between the bags and the energy sleeves due to the contractive tendency of the bags in their expanded condition. When the remaining part of the protruding portion of the product bag is engaged and withdrawn from the final expansion means, the energy sleeve follows and is withdrawn from its position about the expansion means. A highly efficient assembly operation of difficult to handle elements is thus achieved.

I claim:

1. Apparatus for assembling an axially elongated, diametrically expandable and contractible product bag axially within a similarly axially elongated diametrically expandable and contractible open ended energy sleeve of elastomeric material, the sleeve being at least partially diametrically expanded at assembly; said apparatus comprising at least one energy sleeve expansion station, a support for holding an energy sleeve at said station with at least one open end portion exposed axially, a hollow expansion tube at said station axially insertable into the sleeve at its said exposed open end portion whereby to progressively expand the sleeve substantially throughout its length, an energy sleeve and product bag assembly station, means located between said expansion station and said assembly station for transporting an expanded energy sleeve with the hollow expansion tube therewithin from said sleeve expansion station to said assembly station, means located adjacent said assembly station for transporting a product bag to said assembly station and into a position of axial alignment with said energy sleeve and expansion tube, means adjacent said assembly station for effecting relative axial movement between said product bag and both said sleeve and the expansion tube therewithin whereby to insert the bag in the tube within the sleeve with one end portion thereof protruding from the tube and the sleeve an energy sleeve and product bag withdrawal station, means at said withdrawal station for effecting relative axial movement between said sleeve and both said expansion tube and product bag whereby to position said sleeve with one end portion extending beyond said expansion tube and surrounding said bag along at least a part of its protruding end portion, said sleeve thus frictionally gripping said bag at its said protruding end portion due to its compressive tendency in its expanded condition, and a withdrawal means at said withdrawal station for engaging said protruding end portion of said product bag at a remaining part thereof and simultaneously and in assembly axially withdrawing both said bag from within said expansion tube and said sleeve from its position about the tube.

2. Apparatus for assembling an axially elongated, diametrically expandable and contractible product bag within an energy sleeve of elastomeric material as set forth in claim 1 wherein at least two expansion stations are provided for the sequential expansion of said energy sleeve.

3. Apparatus for assembling an axially elongated, diametrically expandable and contractible product bag within an energy sleeve of elastomeric material as set forth in claim 2 wherein three expansion stations are provided for the sequential expansion of said energy sleeve.

4. Apparatus for assembling an axially elongated, diametrically expandable and contractible product bag within an energy sleeve of elastomeric material as set forth in claim 3 wherein each of said expansion stations includes an expansion means axially insertable within an energy sleeve, wherein an expansion means at a first station is axially insertable within an expansion tube at a second station to transfer said sleeve to and about said expansion tube at the second station, and wherein the expansion tube at the second station is axially insertable within an expansion tube at the third station to transfer said sleeve to and about the expansion tube at said third expansion station.

5. Apparatus for assembling an axially elongated, diametrically expandable and contractible product bag within an energy sleeve of elastomeric material as set forth in claim 4 wherein energy sleeve transfer means are provided between said expansion stations and include indexable tables for transporting said expansion means with energy sleeves thereon, said tables serving to axially align successive expansion means and sleeves for transfer of the sleeves from one expansion means to the next.

6. Apparatus for assembling an axially elongated, diametrically expandable and contractible product bag within an energy sleeve of elastomeric material as set forth in claim 4 wherein air jets are provided for assistance in initiating necessary expansion and axial transfer movement of said energy sleeves from one expansion means to another.

7. Apparatus for assembling an axially elongated, diametrically expandable and contractible product bag within an energy sleeve of elastomeric material as set forth in claim 4 wherein a continuous supply of elastomeric energy sleeve material is provided adjacent said first expansion station, wherein means is provided for intermittently severing lengths of such material as required to form individual energy sleeves, and wherein transfer means is provided adjacent said first expansion station for introducing said sleeves in succession to said first expansion station.

8. Apparatus for assembling an axially elongated, diametrically expandable and contractible product bag within an energy sleeve of elastomeric material as set forth in claim 4 wherein pre-cut energy sleeves are provided and stored, and wherein a feed means is provided adjacent said first expansion station for intermittently introducing said pre-cut sleeves in succession to said first expansion station.

9. Apparatus for assembling an axially elongated, diametrically expandable and contractible product bag within an energy sleeve of elastomeric material as set forth in claim 1 wherein said product bags include diametrically enlarged closure means at said one end portion, and wherein said withdrawal means engages said bag axially inwardly of said closure means and axially withdraws said bags and sleeves in assembly as aforesaid.

10. Apparatus for assembling an axially elongated, diametrically expandable and contractible product bag within an energy sleeve of elastomeric material as set forth in claim 9 wherein a discharge means is provided for engaging and laterally moving said assembled sleeves and bags after removal from said expansion means by said withdrawal means.

* * * * *